US009582015B2

(12) United States Patent
Taniguchi

(10) Patent No.: US 9,582,015 B2
(45) Date of Patent: Feb. 28, 2017

(54) VOLTAGE REGULATOR

(71) Applicant: Seiko Instruments Inc., Chiba-shi, Chiba (JP)

(72) Inventor: Tomomi Taniguchi, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/188,348

(22) Filed: Feb. 24, 2014

(65) Prior Publication Data

US 2014/0239928 A1 Aug. 28, 2014

(30) Foreign Application Priority Data

Feb. 27, 2013 (JP) ..... 2013-037741

(51) Int. Cl.
*G05F 1/575* (2006.01)
*G05F 1/56* (2006.01)
*G05F 3/26* (2006.01)

(52) U.S. Cl.
CPC ..... *G05F 1/56* (2013.01); *G05F 1/575* (2013.01); *G05F 3/262* (2013.01)

(58) Field of Classification Search
USPC ..... 323/280–285, 271, 273–275
See application file for complete search history.

(56) References Cited

U.S. PATENT DOCUMENTS

2004/0130306 A1* 7/2004 Sudou et al. ..... 323/282
2012/0146603 A1* 6/2012 Heng ..... G05F 1/575 323/282
2012/0194147 A1* 8/2012 Socheat ..... 323/265
2012/0242312 A1* 9/2012 Heng ..... 323/282
2012/0262137 A1* 10/2012 Arigliano ..... G05F 1/573 323/277

FOREIGN PATENT DOCUMENTS

JP 2004-062374 A 2/2004

* cited by examiner

*Primary Examiner* — Timothy J Dole
*Assistant Examiner* — Bryan R Perez
(74) *Attorney, Agent, or Firm* — Brinks Gilson & Lione

(57) ABSTRACT

There is provided a voltage regulator that stably operates without using a large phase compensation capacitance. The voltage regulator has a voltage 3-stage amplifier circuit comprised of a differential amplifier circuit, a first source ground amplifier circuit provided with a phase compensation circuit, and a second source ground amplifier circuit, which serves as an output circuit. The voltage 3-stage amplifier circuit is provided, between the first source ground amplifier circuit and the second source ground amplifier circuit, with a phase compensation circuit that is effective for reducing the gains of the differential amplifier circuit and the first source ground amplifier circuit.

2 Claims, 2 Drawing Sheets

VOLTAGE REGULATOR

RELATED APPLICATIONS

This application claims priority under 35 U.S.C. §119 to Japanese Patent Application No. 2013-037741 filed on Feb. 27, 2013, the entire content of which is hereby incorporated by reference.

BACKGROUND OF THE INVENTION

Field of the Invention

The present invention relates to phase compensation of a voltage regulator.

Background Art

In general, a voltage regulator receives an input voltage supplied to an input terminal thereof and generates a fixed output voltage to an output terminal thereof. The voltage regulator supplies current according to a load to always maintain the output voltage at a constant level.

FIG. 2 is a circuit diagram of a conventional voltage regulator.

A reference voltage circuit 10 generates a reference voltage VREF. Bleeder resistors 11 and 12 divide an output voltage VOUT of an output terminal 3 to generate a feedback voltage VFB. A differential amplifier circuit 13 receives the reference voltage VREF and the feedback voltage VFB through the input terminal thereof An output voltage of the differential amplifier circuit 13 is input to a constant current source 17 and the gate of a PMOS transistor 16 constituting a first source ground amplifier circuit. A resistor 14 and a capacitance 15 form a phase compensation circuit. An output control MOS transistor 25 constituting a second source ground amplifier circuit receives, through the gate thereof, an output voltage of the first source ground amplifier circuit. A load is connected to the output terminal 3 of the voltage regulator.

The operation of the conventional voltage regulator will be described.

If the output voltage VOUT of the output terminal of the voltage regulator decreases, then the feedback voltage VFB decreases. If the feedback voltage VFB decreases below the reference voltage VREF, then the output of the differential amplifier circuit 13 increases and the ON resistance of the PMOS transistor 16 increases. This causes the output voltage of the first source ground amplifier circuit to decrease, so that the ON resistance of the output control MOS transistor 25 decreases. Hence, the output voltage VOUT of the output terminal of the voltage regulator increases.

Meanwhile, when the output voltage VOUT of the output terminal of the voltage regulator increases, the voltage regulator performs an operation that is opposite from the above, so that the output voltage VOUT of the output terminal of the voltage regulator decreases. Thus, the voltage regulator works to make the feedback voltage VFB and the reference voltage VREF equal so as to generate the constant output voltage VOUT.

The voltage regulator is required to have a wider frequency band in which feedback amplification is possible so as to improve its transient response characteristics. The conventional voltage regulator is configured to have a voltage 3-stage amplifier circuit to permit an expanded frequency band that allows feedback amplification to be accomplished with a relatively small consumption current, thus improving the transient response characteristics. However, the configuration that involves the voltage 3-stage amplifier circuit tends to cause an electric signal, which has gone round a feedback loop once, to develop a phase lag of 180 degrees or more. This may lead to an unstable operation of the voltage regulator and result in an oscillation in the worst case.

The conventional voltage regulator therefore additionally includes a phase compensation circuit composed of the resistor 14 and the capacitance 15 in order to compensate for the foregoing phase lag. More specifically, the resistor 14 and the capacitance 15 resets the phase at a zero point thereby to prevent an oscillation (refer to, for example, Patent Document 1).

[Patent Document 1] Japanese Patent Application Laid-Open No. 2004-62374

However, according to the conventional voltage regulator, in the case where the gate capacitance of an output control MOS transistor is large, a phase compensation capacitance that is equivalent to or larger than the foregoing gate capacitance is required to accomplish pole separation. This inevitably increases a chip area with a resultant higher cost.

SUMMARY OF THE INVENTION

The present invention has been made to solve the problem with the prior art and an object of the invention is to provide a voltage regulator that stably operates without using a large phase compensation capacitance.

To this end, a voltage regulator in accordance with the present invention includes a voltage 3-stage amplifier circuit comprised of a differential amplifier circuit, a first source ground amplifier circuit provided with a phase compensation circuit, and a second source ground amplifier circuit, which serves as an output circuit, the voltage 3-stage amplifier circuit being provided, between the first source ground amplifier circuit and the second source ground amplifier circuit, with a phase compensation circuit that is effective for reducing the gains of the differential amplifier circuit and the first source ground amplifier circuit.

The voltage regulator in accordance with the present invention configured as described above is capable of reducing the gains of the differential amplifier circuit and the first source ground amplifier circuit, thus providing an effect for making it easy to secure a phase margin. The ease of securing a phase margin makes it possible to obtain a voltage regulator that stably operates without using a large phase compensation capacitance.

DETAILED DESCRIPTION OF THE PREFERRED EMBODIMENTS

Figure 1:
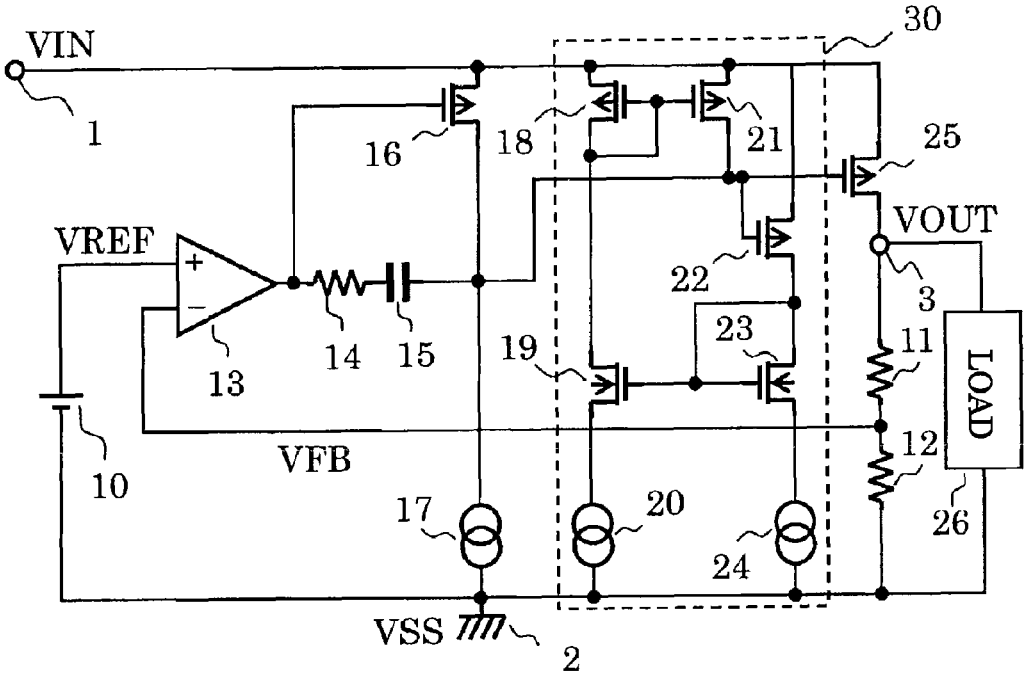
FIG. 1 is a circuit diagram of a voltage regulator according to an embodiment of the present invention.
Figure 2:
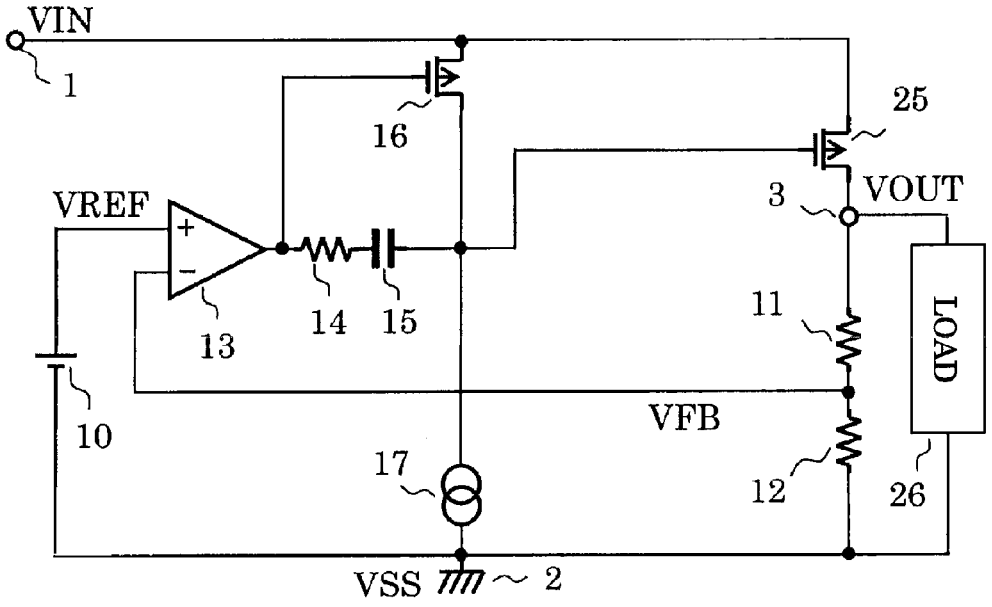
FIG. 2 PRIOR ART
FIG. 2 is a circuit diagram of a conventional voltage regulator.

FIG. 1 is a circuit diagram of a voltage regulator according to an embodiment of the present invention.

The voltage regulator according to the present embodiment has an input terminal 1, a ground terminal 2, an output terminal 3, a reference voltage circuit 10, bleeder resistors 11 and 12, a differential amplifier circuit 13, a resistor 14 and a capacitance 15, which constitute a first phase compensation circuit, a PMOS transistor 16, a constant current source 17, an output control MOS transistor 25, and a second phase compensation circuit 30. The second phase compensation circuit 30 is comprised of PMOS transistors 18, 21 and 22, NMOS transistors 19 and 23, and constant current sources 20 and 24.

The differential amplifier circuit 13 has a non-inverting input terminal thereof connected to the reference voltage circuit 10, an inverting input terminal thereof connected to a connection point of the bleeder resistors 11 and 12, and an output terminal thereof connected to a gate of the PMOS transistor 16. The PMOS transistor 16 has a source thereof connected to the input terminal 1 and a drain thereof connected to one terminal of the constant current source 17 and a gate of the output control MOS transistor 25. The resistor 14 and the capacitance 15 are connected between a drain and the gate of the PMOS transistor 16. The other terminal of the constant current source 17 is connected to the ground terminal 2. The output control MOS transistor 25 has a source thereof connected to the input terminal 1 and a drain thereof connected to the output terminal 3. The bleeder resistor 11 and the bleeder resistor 12 are connected between the output terminal 3 and the ground terminal 2.

The connection of the second phase compensation circuit 30 will now be described. The PMOS transistor 22 has a source thereof connected to the input terminal 1 and a gate thereof connected to the gate of the output control MOS transistor 25. The NMOS transistor 23 has a drain and a gate thereof connected to a drain of the PMOS transistor 22 and a gate of the NMOS transistor 19 and a source thereof connected to the constant current source 24. The NMOS transistor 19 has a source thereof connected to the constant current source 20 and a drain thereof connected to the gate and the drain of the PMOS transistor 18. The PMOS transistor 18 has a source thereof connected to the input terminal 1 and a gate and a drain thereof connected to a gate of the PMOS transistor 21. The PMOS transistor 21 has a source thereof connected to the input terminal 1 and a drain thereof connected to the gate of the output control MOS transistor 25.

The operation of the voltage regulator according to the present embodiment will now be described.

The bleeder resistors 11 and 12 divide an output voltage VOUT of the output terminal 3 to generate a feedback voltage VFB. The reference voltage circuit 10 outputs a reference voltage VREF. The differential amplifier circuit 13 compares the reference voltage VREF and the feedback voltage VFB and controls a gate voltage of the output control MOS transistor 25 such that the output voltage VOUT remains constant.

If the output voltage VOUT decreases, then the feedback voltage VFB decreases. If the feedback voltage VFB reduces below the reference voltage VREF, then the output voltage of the differential amplifier circuit 13 increases. The ON resistance of the PMOS transistor 16 increases, so that the gate voltage of the output control MOS transistor 25 decreases. The ON resistance of the output control MOS transistor 25 decreases, thus increasing the output voltage VOUT.

Meanwhile, when the output voltage VOUT increases, the voltage regulator performs an operation that is opposite from the foregoing operation, causing the output voltage VOUT to decrease. Thus, the output voltage VOUT of the voltage regulator becomes a constant voltage.

The operation of the second phase compensation circuit 30 will now be described.

The PMOS transistor 22 senses the drain current of the output control MOS transistor 25, i.e. the current of the output terminal. The sensed current is mirrored as the drain current of the NMOS transistor 19 by an N-ch current mirror circuit comprised of the NMOS transistors 19 and 23. The drain current of the NMOS transistor 19 is mirrored as the drain current of the PMOS transistor 21 by a P-ch current mirror circuit comprised of the PMOS transistors 18 and 21.

In this case, when the output voltage VOUT decreases and then the output voltage VOUT is increased, the ON resistance of the output control MOS transistor 25 decreases, thus increasing the output current. The PMOS transistor 21 senses the output current of the output control MOS transistor 25 and passes a sense current based on the output current. Then, the sense current is passed to the gate of the output control MOS transistor 25 through the intermediary of the N-ch current mirror circuit and the P-ch current mirror circuit.

Thus, passing the current based on the output current to the gate of the output control MOS transistor 25 makes it possible to reduce the gains of the differential amplifier circuit and the first source ground amplifier circuit and thereby to prevent a phase lag of an electric signal of a feedback loop. This allows a phase margin of an amplifier circuit to be secured, thus obviating the need for a large capacitance value of the capacitance 15 of the first phase compensation circuit even in the case where the gate capacitance of the output control MOS transistor is large.

The constant current source 24 is provided between the source of the NMOS transistor 23 and the ground terminal 2 in order to set the drain current of the MOS transistor 21 to an appropriate current while preventing the drain current of the MOS transistor 21 from becoming larger than the constant current of the constant current source 17. Without the constant current source 24, the gate voltage of the output control MOS transistor 25 would inconveniently increase. The constant current source 24 restricts the drain current of the PMOS transistor 21 to a predetermined value or less.

Further, the constant current source 20 is provided to make the source voltages of the NMOS transistors 19 and 23 equal.

As described above, the provision of the second phase compensation circuit reduces the gains of the differential amplifier circuit 13 and the first source ground amplifier circuit thereby to secure a phase margin. This makes it possible to obtain a voltage regulator that stably operates without using a large phase compensation capacitance in the first phase compensation circuit.

What is claimed is:

1. A voltage regulator comprising:

a reference voltage circuit that outputs a reference voltage;

a voltage dividing circuit that outputs a feedback voltage obtained by dividing an output voltage;

a differential amplifier circuit that receives the reference voltage and the feedback voltage and outputs a control voltage obtained by amplifying a difference between the reference voltage and the feedback voltage;

a first source ground amplifier circuit that amplifies the control voltage output from the differential amplifier circuit;

a first phase compensation circuit provided between an output terminal and an input terminal of the first source ground amplifier circuit;

an output control MOS transistor constituting a second source ground circuit that receives a control voltage output from the first source ground amplifier circuit and controls the output voltage; and a second phase compensation circuit provided at a gate of the output control MOS transistor, wherein the second phase compensation circuit comprises:

a sense transistor that passes a sense current based on a drain current of the output control MOS transistor;

a current mirror circuit that mirrors the sense current and passes the mirrored current to the gate of the output control MOS transistor, an output of the current mirror circuit connected to the gate of the sense transistor and to the gate of the output control MOS transistor; and a first constant current source and a second constant current source connected at a first side to the current mirror circuit, the second constant current source comprising a current restricting circuit, where the second constant current source restricts the current passed by the current mirror circuit, the first and second constant current sources further connected at a second side to a ground potential, wherein a current of both the first and second constant current sources is smaller than a current flowing in a third constant current source connected to the output of the differential amplifier circuit.

2. The voltage regulator according to claim 1, wherein the current mirror circuit comprises an N-channel current mirror circuit and a P-channel current mirror circuit, and the second phase compensation circuit further comprises a second constant current source that sources voltage to the N-channel current mirror circuit.

* * * * *